United States Patent [19]

Ogawa et al.

[11] Patent Number: 4,858,272

[45] Date of Patent: Aug. 22, 1989

[54] DOOR CLOSING DEVICE

[75] Inventors: Kazuaki Ogawa; Miyoshi Shiramasa, both of Hiroshima, Japan

[73] Assignee: Ryobi Ltd., Hiroshima, Japan

[21] Appl. No.: 160,383

[22] Filed: Feb. 25, 1988

[30] Foreign Application Priority Data

Jun. 1, 1987 [JP] Japan ..... 62-85978[U]
Jul. 27, 1987 [JP] Japan ..... 62-11546[U]

[51] Int. Cl.[4] ..... E05F 1/08
[52] U.S. Cl. ..... 16/80; 16/71
[58] Field of Search ..... 16/80, 78, 71, 49, 65; 49/386

[56] References Cited

U.S. PATENT DOCUMENTS 2,693,614 11/1954 Morawetz ..... 16/80 X

*Primary Examiner*—Nicholas P. Godici
*Assistant Examiner*—Carmine Cuda
*Attorney, Agent, or Firm*—Sughrue, Mion, Zinn, Macpeak & Seas

[57] ABSTRACT

An improved door closing device has a door closer main body for exerting a closing force on a door, a guide rail for guiding a slider, a tension spring provided in the guide rail and a releasably connecting device for releasably connecting the tension spring with the slider at a certain angular position of the door whereby a closing force can be additionally exerted near a position where the door is completely opened.

6 Claims, 6 Drawing Sheets

DOOR CLOSING DEVICE

BACKGROUND OF THE INVENTION

This invention relates to a door closing device for reinforcing a closing force when a door is closed.

Recently, there has appeared a type of door closing device in which a door closer main body is fixed to a vertical portion of a door frame and in which a guide rail is fixed to an upper portion of the door. The door closing device restricts the opening movement of the door when opened and exerts a closing or latching force on the door when the door is released. A slide member is slidably held by the guide rail and urged by a tension spring in the direction where the door is closed. The slide member is rotatably connected to the door closer main body through a connecting arm.

In this type of the door closing device there is minimal space for mounting the door closer main body on the vertical frame. Accordingly, as only a small door closer main body can be used, sufficient door closing force cannot be obtained to maintain a latching force when the door is completely closed. To compensate for the lack of the latching force, the tension spring is generally provided along the guide rail.

The tension spring is expanded or compressed through a total stroke of the door opening and closing movements. Therefore, the tension spring is expanded for a relatively long distance. This requires a substantially large spring to assure durability. Further, the reliability of the door closing device is decreased. In addition, the size of the guide rail must be increased.

SUMMARY OF THE INVENTION

It is an object of this invention to provide an improved door closing device in which a necessary latching or closing force is exerted on the door shortly before a door is completely closed and the latching or closing force is released when the door is opened thereby allowing the door to open easily and smoothly.

According to this invention, there is provided an improved door closing device for reinforcing the door closing or latching force before a door is completely closed, which comprises: a door closer main body for restricting a swinging motion of the door when the door is opened and exerting closing force on the door when the door is closed; a guide rail provided on the door for guiding a slider there along, an arm for connecting a main axis of the door closer main body with the slider; a tension spring provided in the guide rail for additionally exerting a closing force on the door; a releasably connecting means for releasably connecting the tension spring with the slider when the door is swung to a certain angular position near a position where the door is completely closed.

The nature, utility, and further features of this invention will be more clearly apparent from the following detailed description with respect to referred embodiments of the invention when read in conjunction with the accompanying drawings briefly described below.

DETAILED DESCRIPTION OF THE INVENTION

A conventional door closing device will be first presented below with reference to FIG. 8(A) and 8(B) principally for the purpose of comparison therebetween.

Figure 8A:
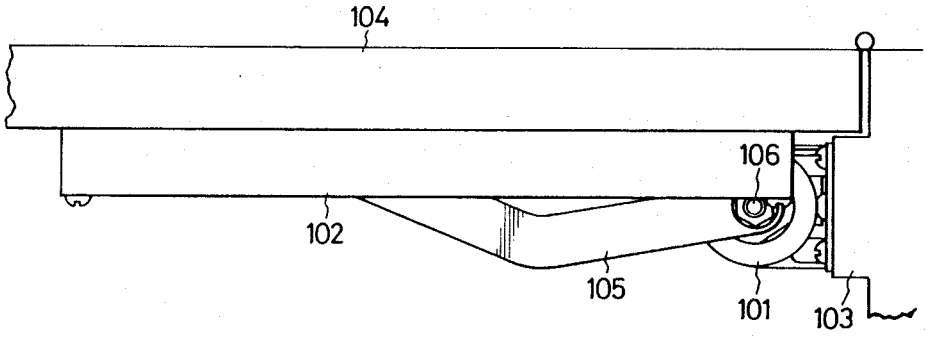
FIG. 8(A) PRIOR ART
FIG. 8(A) is plan view of a conventional door closing device.

In FIG. 8(A) and (B), the main body 101 of a door closer is fixed to a vertical frame 103 while a guide rail 102 is fixed to a door 104. The manner of fixing the main body 101 and the guide rail 102 is in contrast with that of a conventional door closer. An arm 105 connects the main axis 106 of the door closer with a slider S of the guide rail 102 through a pin *7a*. The slider S is connected to a tension spring 107 which is expanded and compressed when the door 104 is opened and closed, respectively. However, the slider S is always connected to the spring 107 through a total stroke of the door and is relatively large. Therefore, the spring 107 must be strong and relatively large.

In view of these defects in a conventional door closer, a new door closer discussed below has been invented to overcome these defects.

Figure 1:
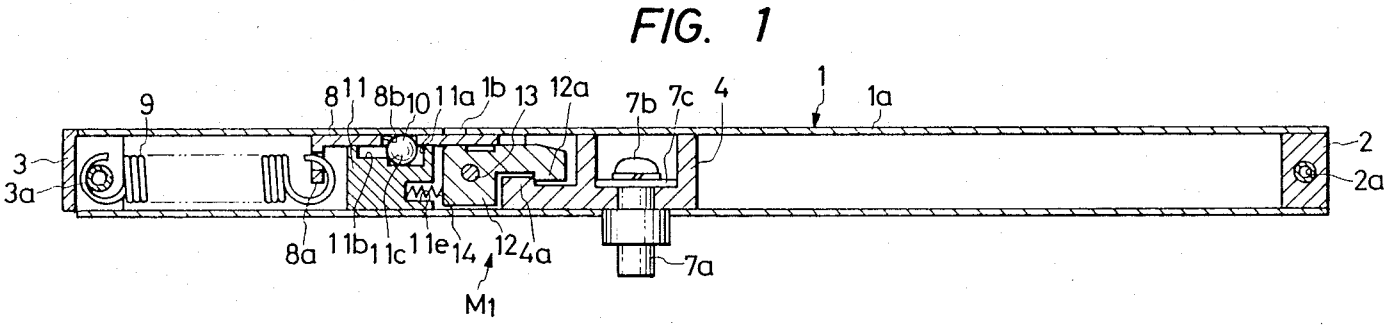
FIG. 1 is a vertical longitudinal view of an improved door closing device according to a first embodiment of this invention.
Figure 8B:
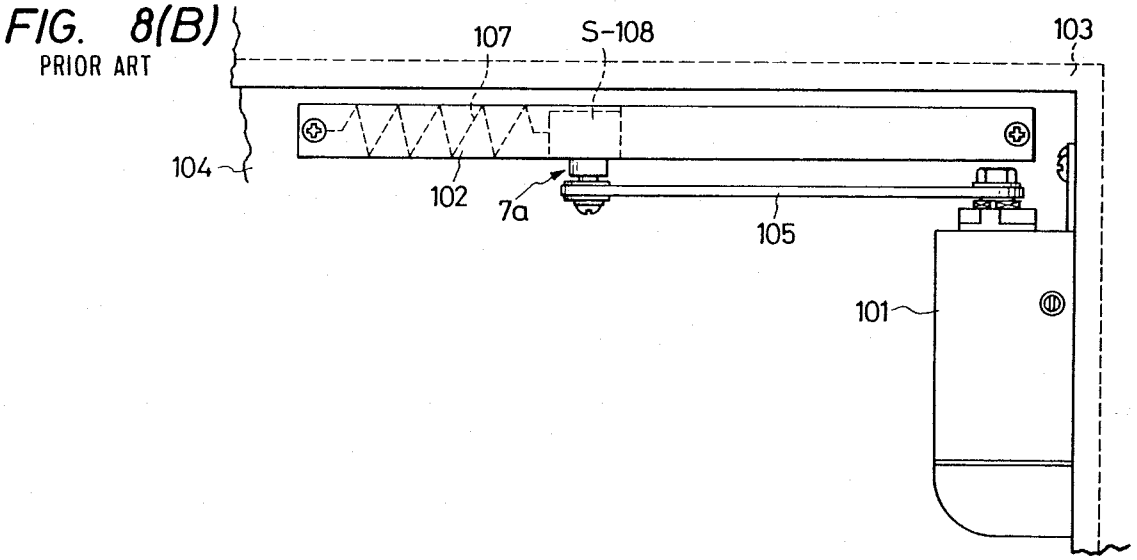
FIG. 8(B) PRIOR ART
FIG. 8(B) is a side view of the conventional door closing device.

An improved door closing device according to the invention comprises a conventional door closer main body 101 as shown in FIGS. 8(A) and 8(B), and conventional connecting arm as shown in FIG. 8(A) and 8(B) whose one end is connected to one end of the door closer main body 101. As shown in FIG. 1, the improved door closing device further includes a slider 4 connected to the other end of the arm, a tension spring 9, a releasably connecting mechanism $M_1$ for releasably connecting the slider 4 with the spring 9 and a guide rail 1 for guiding the slider 4.

The guide rail 1 has an elongated shape in which a slit is provided at its lower face for guiding a pin *7a* connecting the slider 4 with the arm. Opposite ends of the guide rail 1 are provided with two end caps 2,3 which have two fixing pins *2a*, *3a* for fixing the guide rail 1 to the door, respectively. The fixing pin *3a* holds one end of the tension spring 9.

The guide rail 1 has a stopping hole *1b* on its top rail *1a* near the left end of the guide rail 1 as viewed in FIG. 1. The slider 4 is slidably accommodated in the guide rail 1 and the pin *7a* is fixed to the slider 4 through a washer *7c* and a screw *7b*. The main axis of the door closer main body is connected to the pin *7a* through the arm (not shown). The slider 4 slides the length of the guide rail 1 corresponding to the opening and closing operation of the door. The slider 4 has at one end thereof an engaging projection 4*a* facing upward.

The releasably connecting mechanism $M_1$ has a first plate-like clutch member 8 which is slidably accommodated in the guide rail 1 along a sliding face of the top wall 1*a*. The other end of the tension spring 9 is hooked at a hook 8*a* formed at the left end of the first clutch member 8. The tension spring 9 urges the first clutch member 8 in the left direction, as viewed in FIG. 1.

The first clutch member 8 has a through hole 8*b* for loosely receiving a stop ball 10. The through hole 8*b* is located at a position deviated in the leftward direction from the stop hole 1*b* of the guide rail 1 by a certain distance when the door is completely closed, as shown in FIGS. 1. 2 and 3.

Figure 2:
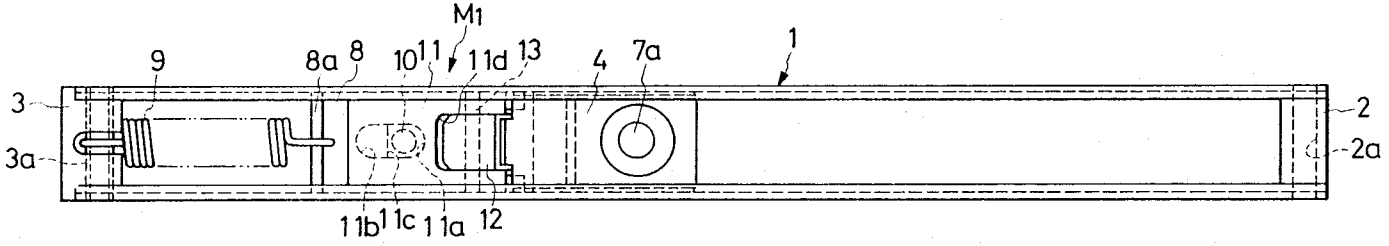
FIG. 2 is a bottom view of an improved door closing device according to a first embodiment of this invention.

Further, in the guide rail 1, there are provided second and third clutch members 11, 12, respectively, slidable in the left and right directions. The second clutch member 11 has a deep groove 11*a* and a shallow groove 11*b*, at its upper face opposite to the lower face of the first clutch member 8, disposed successively in the longitudinal direction of the guide rail 1 so that the stop ball 10 can be moved in the same direction. At the border of the two grooves 11*a*, 11*b* is provided a step 11*c* for pushing the stop ball 10 into the through hole 8*b* and for dropping it onto the deep groove 11*a*. The second clutch member 11 has a recess 11*d* on its right side, as viewed in FIG. 2, for receiving the third clutch member 12 swingably about a pivot pin 13 extending horizontally. The opposite ends of the pivot pin 13 are fixed to the opposite sides of the second clutch member 11.

The third clutch member 12 has, at its front end, an engaging projection 12*a* facing downward which detachably engages with the engaging projection 4*a* of the slider 4.

The second clutch member 11 has on its front wall facing the rear wall face of the third clutch member 12, a recess 11*e* for receiving a compression spring 14. The compression spring 14, in FIG. 1, urges the third clutch member 12 to rotate, about the pin 13, in the counterclockwise direction, that is, a direction where the third clutch member 12 releases the slider 4 therefrom.

Figures 3A, 3B, 3C, 3D:
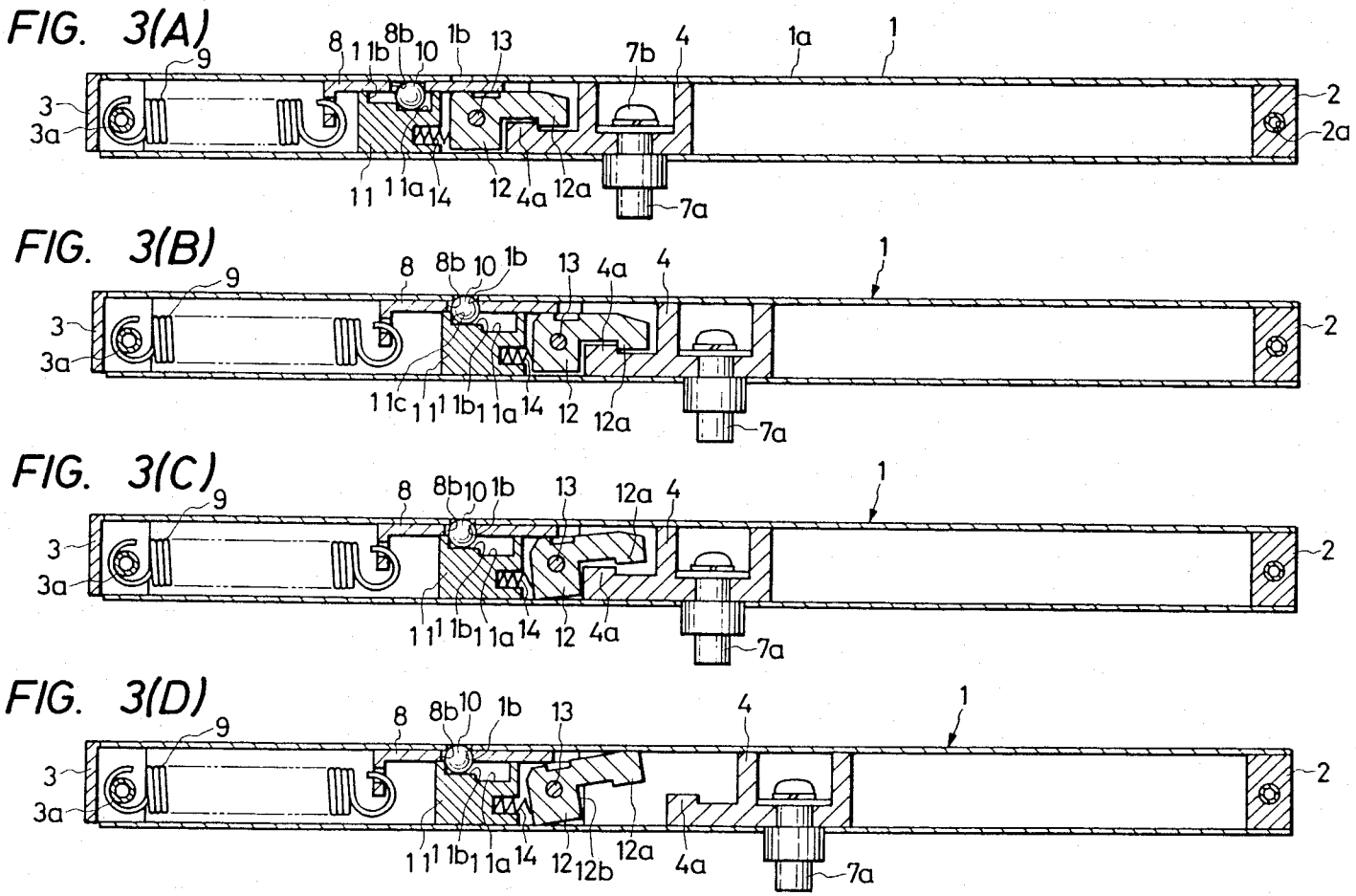
FIGS. 3(A)(B)(C) and (D) are vertical longitudinal views of the improved door closing device for explaining the operation of the device in order, respectively.

However, when the door is completely closed, the third clutch member 12 is, as shown in FIGS. 1 and 3(A), prevented from rotating by abutting against the front (right) end of the first clutch member 8. When the door is opened or swung through a predetermined angle, the third clutch member 12 is slid forward (right direction) by the slider 4 through a certain stroke. At this time, as shown in FIG. 3(C), the third clutch member 12 is rotated by the spring force of the compression spring 14 and the tensile force of the slider 4 in the counterclockwise direction thereby to release the slider 4 therefrom.

The first, second and third clutch members 8, 11 and 12, respectively, operate in the following manner. At the initial opening movement of the door, the three clutch members are moved forward for a certain stroke together with the slider 4 while expanding the tension spring 9. Then, they are released from the slider 4. With the tension spring 9 expanded, the stop ball 10 comes into the stopping hole 1*b* to keep the three clutch members at a position during the opening movement of the door.

The operation of the door closing force supplementing device according to this invention will now be explained with reference to FIGS. 3(A) to 3(D). FIG. 3(A) shows a state wherein the door is closed. In this state, the first clutch member 8 is pulled by the tension spring 9 in the left direction as viewed in FIG. 3(A) and the slider 4 is held by the arm (not shown) at a predetermined position. Therefore, at this time, the first, second and third clutch members 8, 11 and 12, respectively, are held on the left side of the guide rail 1 as viewed in FIG. 3(A).

From this state, when the door is opened, the slider 4 is slid by the arm in the right direction, as viewed in the drawings. At this time, the slider 4 and the third clutch member 12 are united with each other while the second clutch member 11, in which the third clutch member 13 is held pivotably, and the first clutch member 8 are united with each other through the stop ball 10. Therefore, when the slider 4 slides to the right, the third clutch member 12 is slid in the right direction, as well, together with the first and second clutch members 8,11, respectively. However, when the second clutch member 11 is slid for a certain stroke corresponding to a swinging angle of the door during its opening movement, the stop ball 10, as shown in FIG. 3(B), slips into the stopping hole 1*b* as a result of being pushed outward for a distance corresponding to the height of the step 11*c* between the deep and shallow grooves 11*a*, 11*b* while the ball 10 is moved from the deep groove 11*a* to the shallow groove 11*b*. When the surface of the ball 10 engages with the rear end 11*c* of the shallow groove 11 and the inner surface of through hole 8*b* at the same time, the first clutch member 8, the second clutch member 11 and the guide rail 1 are united with each other in a state wherein the tension spring 9 is expanded in response to the movement of the slider 4, to thereby store an additional closing force of the door.

At this time, the second clutch member 11 is moved for the length of the shallow groove 11*b* in the right direction relative to the first clutch member 8 to release the restriction of the rotation of the third clutch member 12. Therefore, the third clutch member 12 is, as shown in FIG. 3(C), rotated by the pushing force of the compression spring 14 and the tensile force of the slider 4 to thereby release the engagement of the third clutch member 12 and the slider 4. Therefore, the slider 4 can be slid freely in the right direction as shown in FIG. 3(C) while the door is further opened.

When the door is closed after its complete opening, the slider 4 is slid in the left direction as shown in FIG. 3(D), and the front end of the engaging projection 4*a* of the slider 4 abuts against the lower front end 12*b* of the third clutch member 12. At this time, the third clutch member 12 is rotated in the clockwise direction against the spring force of the compression spring 14. As a result, the slider 4 is engaged with the third clutch member 12 again.

As the door is closed further, the third clutch member 12 and the second clutch member 11 are slid in the left direction with respect to the first clutch member 8. At this time, the stop ball 10 is dropped from the shallow groove 11*b* onto the deep groove 11*a*, so that the stop ball 10 comes out of the stopping hole 1*b*. Therefore, the first clutch member 8 is released from the guide rail 1 and the three clutch members and the slider 4 are pulled by the stored additional door closing force in the left direction together. Thus, the door closing force is reinforced by the stored force of the tension spring 9.

Figure 4:
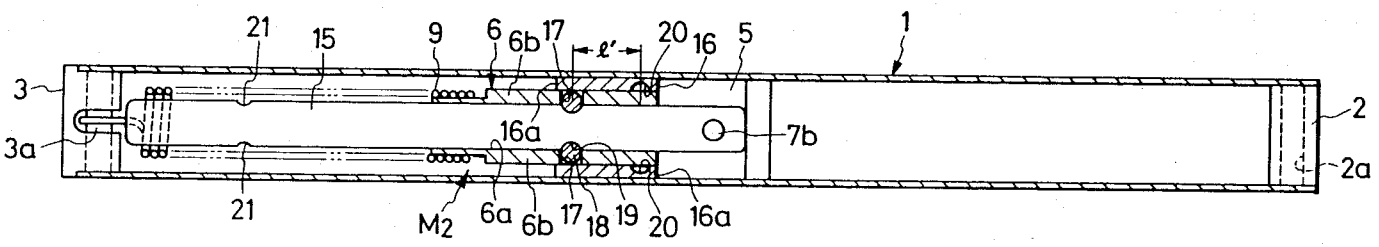
FIG. 4 is a horizontal longitudinal view of the improved supplemental door closing device according to a second embodiment of this invention.
Figure 5:
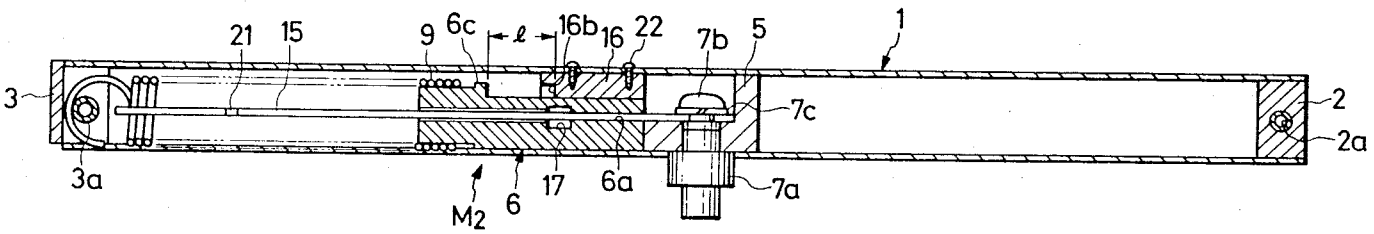
FIG. 5 is a vertical longitudinal view of the improved door closing device according to a second embodiment of this invention.

A second embodiment will now be explained With reference to FIGS. 4 to 7. In FIGS. 4 and 5, a guide rail 1 has a slider 5 slidable in the longitudinal direction of the guide rail 1. The slider 5 is connected to the arm pin 7a. The slider 5 cooperates with a releasably connecting mechanism $M_2$ for releasably connecting the slider 5 with the tension spring 9.

The mechanism $M_2$ comprises a connecting plate 15 for connecting the slider 5 with the tension spring 9 through an auxiliary slider 6. The right (front) end of the connecting plate 15 is pivotably connected to the arm pin 7a through a washer 7c and a screw 7b. The connecting plate 15 is extended, for approximately half the length of the guide rail 1, toward the right (rear) side of the guide rail.

At the center portion of the guide rail 1, in its longitudinal direction, is fixedly provided a roller receiving member 16 through screws 22. The roller receiving member 16 has a U-shaped cross section in which the auxiliary slider 6 is held slidably in the same direction as that of the slider 5. The auxiliary slider 6 has a flat rectangular hole 6a extending therethrough in the longitudinal direction of the slider 6 and the connecting plate 15 slidably passes through the hole 6a. The auxiliary slider 6 is elastically urged by the tension spring 9 to the left (rear) side. The rear end of the spring 9 is hooked on the fixing pin 3a fixed to the end cap 3 while the front end of the spring 9 is fixed to the rear end of the auxiliary slider 6.

The auxiliary slider 6 has, at its two side walls 6b, 6b, a pair of notched spaces 17,17 opposite to each other which are connected to each other in the lateral direction of the guide rail 1. In each notched space 17 is held a roller 18 extending vertically so as to be freely rotatably movable in the lateral direction. The diameter of each roller 18 must have a diameter larger than the thickness of each side wall 6b of the auxiliary slider 6.

The connecting plate 15 is provided, at its two side walls, with a pair of engaging recesses 19,19 opposite to each other for receiving the rollers 18 in a state wherein the outer surface of each roller 18 abuts against the inner face of each of the two side walls 16a, 16a of the roller receiving member 16 when the door is closed as shown in FIGS. 4 and 5. On the inner walls of the left and right side walls 16a of the roller receiving member 16 are formed a pair of engaging recesses 20,20 opposite to each other for receiving the rollers 18, respectively, when the door is opened to a predetermined angular position.

When a projection 6c, provided on the rear end of the auxiliary slider 6, abuts against the rear end face of the roller receiving member 16 or engages with a recess 16b provided on the rear end thereof, the engaging recesses 19 of the connecting plate 15 are in registration with the engaging recesses 20, respectively. That is, the distance 1 between the projection 6c and the recess 16b is equal to a slide stroke 1 of the auxiliary slider 6 between the space 17 and the engaging recess 20 when the door is closed or opened.

Further, the connecting plate 15 has, at a position near its rear end and its two lateral sides, a pair of engaging recesses 21,21 whose depth is smaller than that of the engaging recesses 19. The engaging recesses 21, cooperating with the rollers 18, function to temporarily stop a continuous opening movement of the door shortly before the door is completely opened. That is, each roller 18 engages each engaging recess 21 of the connecting plate 15 to stop the continuous opening operation of the door shortly before the door is fully opened, whereby the door can be stopped smoothly at its final step without impact.

Each of the above recesses 19,20,21 may have approximately semicircular shape to assure a smooth engagement and release between each roller and each recess. Two spherical balls may be used instead of the two rollers 18.

The operation of the second embodiment will now be explained.

When the door is completely closed as shown in FIGS. 4 and 5, the slider is held so as to abut against the forward end of the roller receiving member 16 and the auxiliary slider 6 is urged rearward (to the left as viewed in the drawings) by the tension spring 9 in a state wherein the notched spaces 17 and the recesses 19 receive the respective rollers 18 at the same time.

Figures 6A, 6B, 6C, 6D:
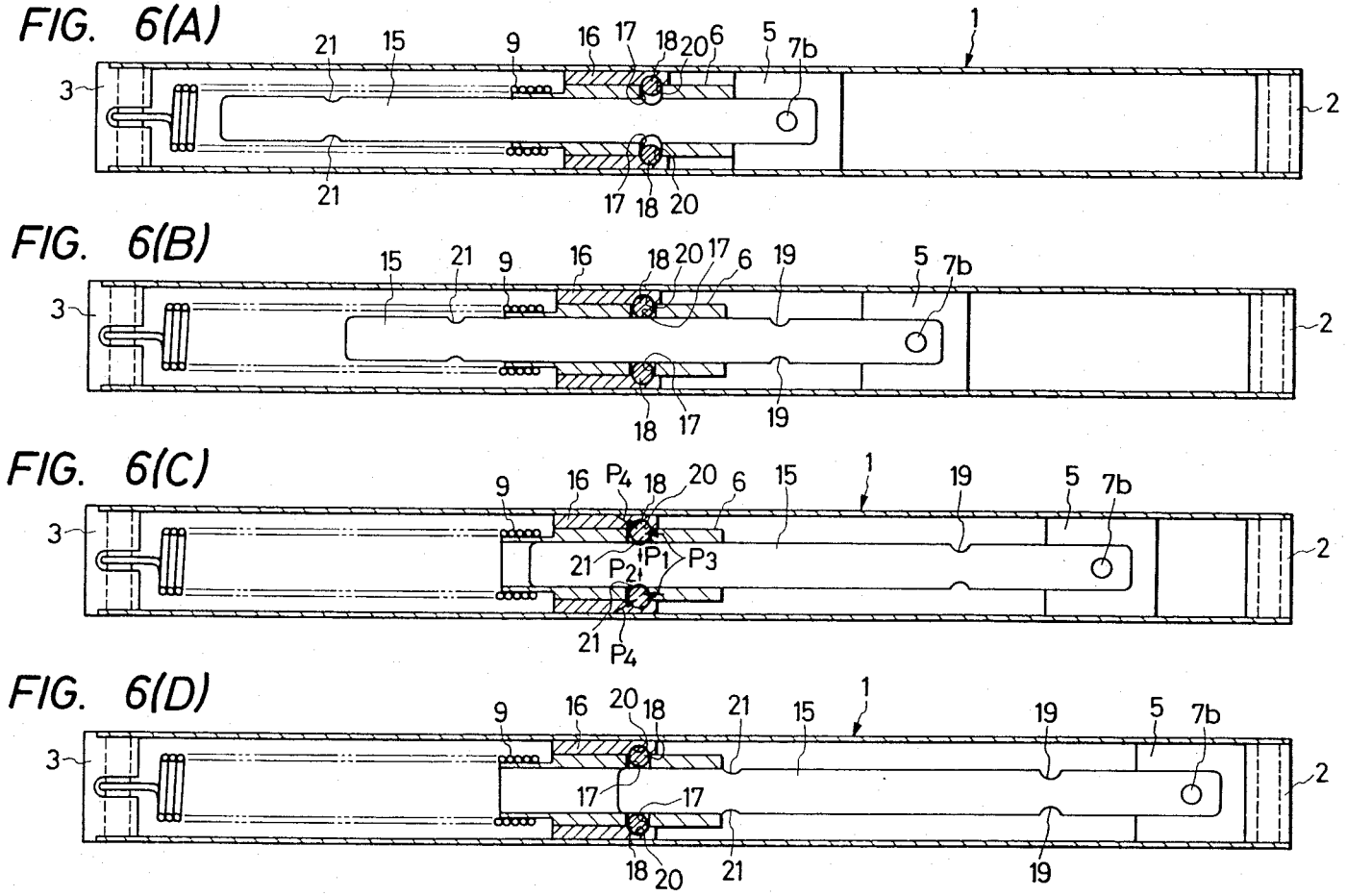
FIG. 6(A)(B)(C) and (D) are horizontal longitudinal views of the improved door closing device for explaining the operation of the device in order, respectively.

When the door is gradually opened from the completely closed condition, the slider 5 is slid forward (in the right direction as viewed in the drawings) by the swinging motion of the arm 104 shown in FIGS. 8(A) and (B). At this time the slider 5 is slid through the stroke 1 in the forward direction together with the auxiliary slider 6 while expanding the tension spring 9 because the connecting plate 15 and the auxiliary slider 6 are united with each other through the engagement of each roller 18 and each engaging recess 19 of the connecting plate 15. This results in storing a door closing force in the tension spring 9. When the rollers 18 reach a position where the engaging recesses 20 are located, the rollers 18 disengage engaging recesses 19 due to a sliding force of the auxiliary slider 6 and the connecting plate 15, to thereby engage with the engaging recess 20, as shown in FIG. 6(A).

Figure 7A:
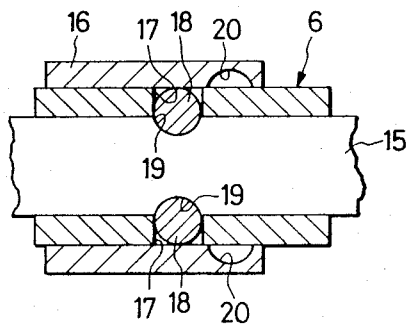
FIGS. 7(A)(B)(C)(D) and (E) are horizontal sectional views for explaining, in order, a state of engagement of rollers and recesses in a region of a door opening stroke.
Figure 7B:
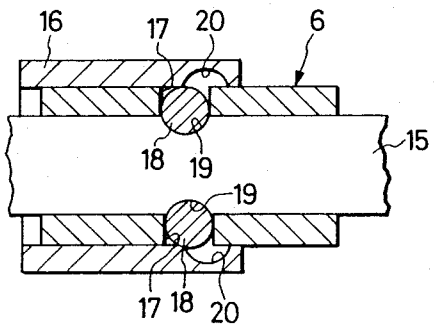
Figure 7C:
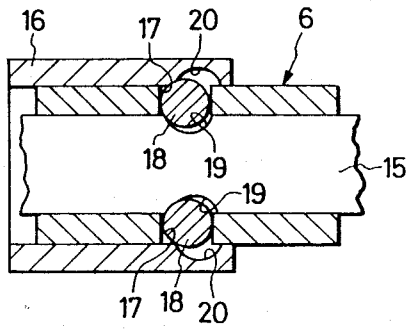
Figure 7D:
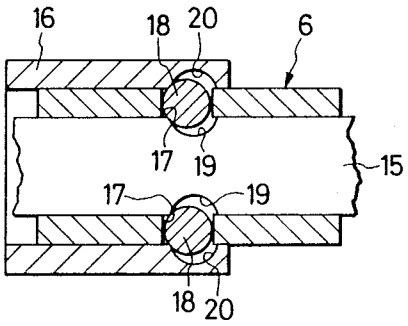
Figure 7E:
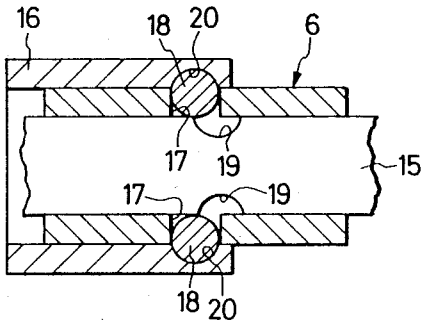

The state of the movement of the rollers 18 and the engagement of the rollers 18 with the engaging recesses 19, 20 are described in FIGS. 7(A) to 7(E). That is, when each roller 18 is located to the left of each engaging recess 20, the roller 18, received in the engaging recess 19 and the space 17, rotates on the inner surface of the roller receiving member 16, as shown in FIG. 7(A). Then as the roller 18 comes near a position where the roller 18 completely registers with the engaging recess 20, the roller 18 is pushed laterally outwardly by the curved surface of the engaging recess 19, as shown in FIGS. 7(B) and (C). When the space 17 and the recess 19 holding the roller 18 completely register with the engaging recess 20 of the roller receiving member 16, the roller 20 disengages from the recess 19 to thereby release the connecting plate 15 and becomes engaged in the space 17 and the recess 20, as shown in FIG. 7(D). Thereafter, the connecting plate 15 can move forward past the roller 18 held in the space 17 and the recess 20, as shown in FIG. 7(E). At this time, the auxiliary slider 6 is fixed to the roller receiving member 16 through the engagement of the roller 18 and the engaging recess 20. Therefore, the tension spring 9 is kept expanded to store an additional door closing (latching) force.

When the slider 5 is further moved forward (in the right direction) to reach a position where the recesses 21, provided on the rear side of the connecting plate 15, register with the rollers 18, held in the spaces 17 and the recesses 20, two forces $p_1$, $p_2$ directed inward are exerted on the rollers 18, respectively. This is because the rollers 18 receive a force $p_3$ directed rearward from the inner walls of the spaces 17 of the auxiliary slider 6 due to the spring force of the tension spring 9 and a repulsive force $p_4$ from the inner surfaces of the engaging recesses 20, as shown in FIG. 6(C). Accordingly, the rollers 18 partially engage the shallow engaging recesses 21 to temporarily stop the continuous opening of the door. However, since each rear engaging recess 21 is relatively shallow, if the slider 5 is pushed further, each roller 18 can easily come out of the recess 21 to open the door further. Then, when the door is fully opened as shown in FIG. 6(D). the slider 5 abuts against the end cap 2 to stop the opening of the door.

When the door is closed from its fully opened condition, the movement of each member is reverse to that in the case of the opening of the door. That is, when the recesses 21 arrive at the position where the rollers 18 is held in the spaces 17 and the recesses 20, respectively, the opening movement of the door is stopped temporarily, as shown in FIG. 6(C). Then, when the slider 5 is moved rearward to the position where the recesses 19 of the connecting plate 15 register with the rollers 18, respectively, the rollers 18 disengage the recesses 20 to release the auxiliary slider 6 from the roller receiving member 16. Thereafter, the slider 5 is pulled by the stored spring force of the tension spring 9.

As is mentioned above, the improved door closing device according to this invention is so formed that a door closing force is additionally exerted on a door only in a region for which a latching force is necessary. Therefore, the durability of a tension spring can be increased while the size of the tension spring and the guide rail can be decreased. Further, as the door is opened freely through the region of the door opening movement after the slider is released from the tension spring, the opening operation of the door can be easily and smoothly carried out without a large force in comparison with a conventional device.

What is claimed is:

1. An improved door closing device for reinforcing a door closing or latching force before a door is completely closed, which comprises:

(a) a door closer main body for restricting a swinging motion of said door when said door is opened and for exerting a closing force on said door when said door is closed;

(b) a guide rail fixed on said door;

(c) a slider slidably disposed within said guide rail;

(d) an arm pivotably connected at one end to said main body and at another end to said slider;

(e) a tension spring provided in said guide rail and connected to said slider for additionally exerting a closing force on said door; and (f) a releasably connecting means for releasably connecting said tension spring with said slider when said door is swung to a certain angular position near a position where said door is completely closed.

2. The improved door closing device according to claim 1, wherein the releasably connecting means comprises:

(a) a first clutch member provided slidably along said guide rail and urged by said tension spring in a direction where said door is closed, said first clutch member having a through hole;

(b) a second clutch member provided along said first clutch member and having a deep groove and a shallow groove successively in a longitudinal direction of said guide rail;

(c) a stop member rotating on said surfaces of said deep and shallow grooves so as to move in said longitudinal direction of said guide rail in order to releasably connect said first and second clutch members with said guide rail and to connect said second clutch member with said first clutch member so that said second clutch member can slide for a predetermined stroke in said longitudinal direction of said guide rail;

(d) a third clutch member supported pivotably by said second clutch member and releasably connected with said slider, said third clutch member being urged by an elastic member in a rotating direction so as to be released from said slider, wherein said stop member is located on said deep groove and engaged with said through hole of said first clutch member so that said second clutch member is united with said first clutch member when said door is opened within a region of door swinging motion from its complete closing condition, and said stop member is moved from said deep groove onto said shallow groove to engage said first clutch member with a stopping hole of said guide rail at a predetermined angular position of said door while said slider is released from said rotated third clutch member.

3. The improved door closing device according to claim 2, wherein said stop member is a spherical ball.

4. The improved door closing device according to claim 2, wherein said third clutch member is urged by a compression spring disposed between two walls of said second and third clutch members.

5. The improved door closing device according to claim 1, wherein said connecting mechanism comprises:

(a) an elongated connecting member whose one end is connected with said slider and which has a pair of engaging recesses for receiving rollers as a stop member;

(b) an auxiliary slider through which said connecting member slidably extends in the longitudinal direction of said guide rail, said auxiliary slider being urged by said tension spring in said direction when said door is closed and having a pair of engaging spaces for said stop member; and (c) a roller receiving member for slidably engaging with said auxiliary slider;

wherein said rollers of said stop member are held in the recesses of said connecting member and, at the same time, the engaging spaces of said auxiliary slider so that said auxiliary slider and said connecting member are united with each other when said door is opened within a region of door swing motion from its complete closing condition while expanding the tension spring, and said rollers come into said engaging recesses of said roller receiving member so that said auxiliary slider is united with said roller receiving member while said connecting member is released from said auxiliary slider at a predetermined position of said door opening motion.

6. The improved door closing device according to claim 5, wherein said connecting member has, on a position far from the slider, a pair of shallow engaging recesses for engaging with said rollers shortly before said door is completely opened.

* * * * *